United States Patent [19]

McGrath et al.

[11] 4,296,922

[45] Oct. 27, 1981

[54] BENCH CLAMP DEVICE

[76] Inventors: Lindsay T. McGrath, 89 Sydney St., Muswellbrook, New South Wales; Gilbert T. McGrath, 25 Mulcare Crescent, Churchill, Victoria, both of Australia

[21] Appl. No.: 151,399

[22] Filed: May 19, 1980

[51] Int. Cl.[3] ..... B25B 1/14

[52] U.S. Cl. ..... 269/211; 269/228

[58] Field of Search ..... 269/211, 228, 165, 247

[56] References Cited

U.S. PATENT DOCUMENTS 4,184,668 1/1980 Johnson ..... 269/228

FOREIGN PATENT DOCUMENTS 31820 2/1973 Australia ..... 269/211

*Primary Examiner*—Robert C. Watson

*Attorney, Agent, or Firm*—Zarley, McKee, Thomte, Voorhees & Sease

[57] ABSTRACT

A tension clamping device is described, which is particularly suited for use as a bench clamp or vice. A workpiece is gripped in the jaws of the clamping device by forcing a pin, which engages notches in an area depending from one of the jaws, to travel in guiding slots until the workpiece is firmly gripped, then holding the pin in this position by an over-center action of the lever controlling the movement of the pin.

8 Claims, 3 Drawing Figures

BENCH CLAMP DEVICE

This invention relates to tension clamp devices, and in particular relates to such devices which take the form of bench clamps or vices.

In Australian Patent Specification No. 496243, there is disclosed a tension clamp device which comprises, in combination, a main jaw co-extensive with an elongated adjusting arm, a movable jaw co-extensive with a hollow housing through which said adjusting arm is adapted to pass freely, a tension lever pivotally attached to and between two side cheeks of said housing, a secondary lever pivotally fastened at one end thereof to said tension lever, the other end of said secondary lever being constrained with respect to said housing by means of a pin in sliding relationship with respect to a pair of registering travelling slots, each formed within a respective one of said side cheeks of said housing, said pin being adapted to engage selectively one of a number of semi-circular notches formed within an edge of said adjusting arm remote from said main jaw, and said pair of travelling slots being adapted to guide sliding movement of said pin therealong from a first position wherein said pin is free of engagement with said notches to a second position wherein said pin engages said one of said notches, whereby pivotal movement of said tension lever with respect to said housing initially causes said pin to slide along said pair of travelling slots from said first position to said second position whereby free sliding motion of said adjusting arm within said housing is prevented by the engagement of said pin in said notch, and then causes said housing to lock securely with respect to said adjusting arm by an over-centre action to grip firmly within said jaws any work-piece located therebetween.

As described in Specification No. 496243, it is preferred that each of the pair of travelling slots is arcuate at the end thereof corresponding to said first position of said pin. Preferably also, the secondary lever is pivotally fastened to the tension lever by a swivel pin adapted for adjustable location within a travelling slot formed in the tension lever. Such adjustable location may be provided by means of a rotatable handle on said tension lever in threaded engagement with an adjusting member extending longitudinally of said tension lever from said handle to the swivel pin, whereby rotation of said handle will cause said adjusting member to slide said swivel pin in said travelling slot.

The present invention is directed to a further development of the tension clamp device of Specification No. 496243 which is particularly adapted for mounting on a fixed base whereby the clamp device may be used as a bench clamp or vice.

According to the present invention, there is provided an improved tension clamp device which comprises, in combination, a movable jaw co-extensive with an elongated adjusting arm, a hollow housing through which said adjusting arm is adapted to pass freely, said hollow housing being adapted to be mounted on a fixed base and having a main jaw integral therewith, a tension lever pivotally attached to and between two spaced, parallel side cheeks of said housing, a secondary lever pivotally fastened at one end thereof to said tension lever, the other end of said secondary lever being constrained with respect to said housing by means of a pin in sliding relationship with respect to a pair of registering travelling slots, each formed within a respective one of said side cheeks of said housing, said pin being adapted to engage selectively one of a plurality of notches formed in a rack extending longitudinally of said adjusting arm, and said pair of travelling slots being adapted to guide sliding movement of said pin therealong from a first position wherein said pin is free of engagement with said notches to a second position wherein said pin engages said one of said notches, whereby pivotal movement of said tension lever with respect to said housing initially causes said pin to slide along said pair of travelling slots from said first position to said second position whereby free sliding motion of said adjusting arm within said housing is prevented by the engagement of said pin in said notch, and then causes said housing to lock securely with respect to said adjusting arm by an over-centre action to grip firmly within said jaws any work-piece located therebetween.

As will be apparent, the mode of operation of the clamp device of this invention is basically the same as that of the device of Specification No. 496243. Thus, it is also preferred in accordance with the present invention that each of the pair of travelling slots is arcuate at the end thereof corresponding to said first position of said pin. Preferably also, the secondary lever is pivotally connected to the tension lever by a swivel pin adapted for adjustable location within a travelling slot formed in the tension lever. Such adjustable location may be provided by means of a rotatable handle on said tension lever in threaded engagement with an adjusting member extending longitudinally of said tension lever from said handle to the swivel pin, whereby rotation of said handle will cause said adjusting member to slide said swivel pin in said travelling slot.

Since the device of the present invention is particularly intended for use as a bench clamp or vice, it is preferred that the elongate adjusting arm is constructed with a hollow square or rectangular cross-section, and has the longitudinal rack affixed along one side thereof, preferably the side which is uppermost in use, extending outwardly from the adjusting arm. A plate which forms, or forms a base for, the movable jaw is affixed at one end of the adjusting arm transversely to the longitudinal direction thereof, and, if desired, a removable jaw member may be provided on this plate. Preferably a handle is provided on the side of this plate remote from the adjusting arm. Preferably also, the hollow housing is constructed with a base plate, which is adapted to be mounted on a fixed base, for example by means of bolts, screws or the like passing through apertures provided in the base plate, side plates and a top plate, so as to closely surround the adjusting arm while still allowing the arm to pass freely therethrough. The top plate is preferably in two sections, each of which sections extend from one of the side plates to a position adjacent a respective side of the rack. Each of the spaced, parallel side cheeks is provided on a respective one of the top plate sections so that the rack is aligned therebetween. A plate which forms, or forms a base for, the main jaw is affixed at one end of the hollow housing transversely to the longitudinal direction thereof, and, if desired, a removable jaw member may be provided on this plate also.

Further features of the present invention will be apparent from the following description, given by way of example only, of a preferred embodiment of the invention.

Figure 2:
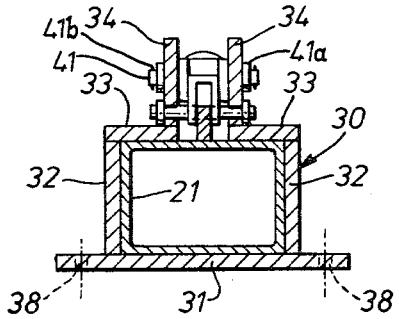
FIG. 2 shows, in cross-section, a view along the line A—A of FIG. 1.
Figure 3:
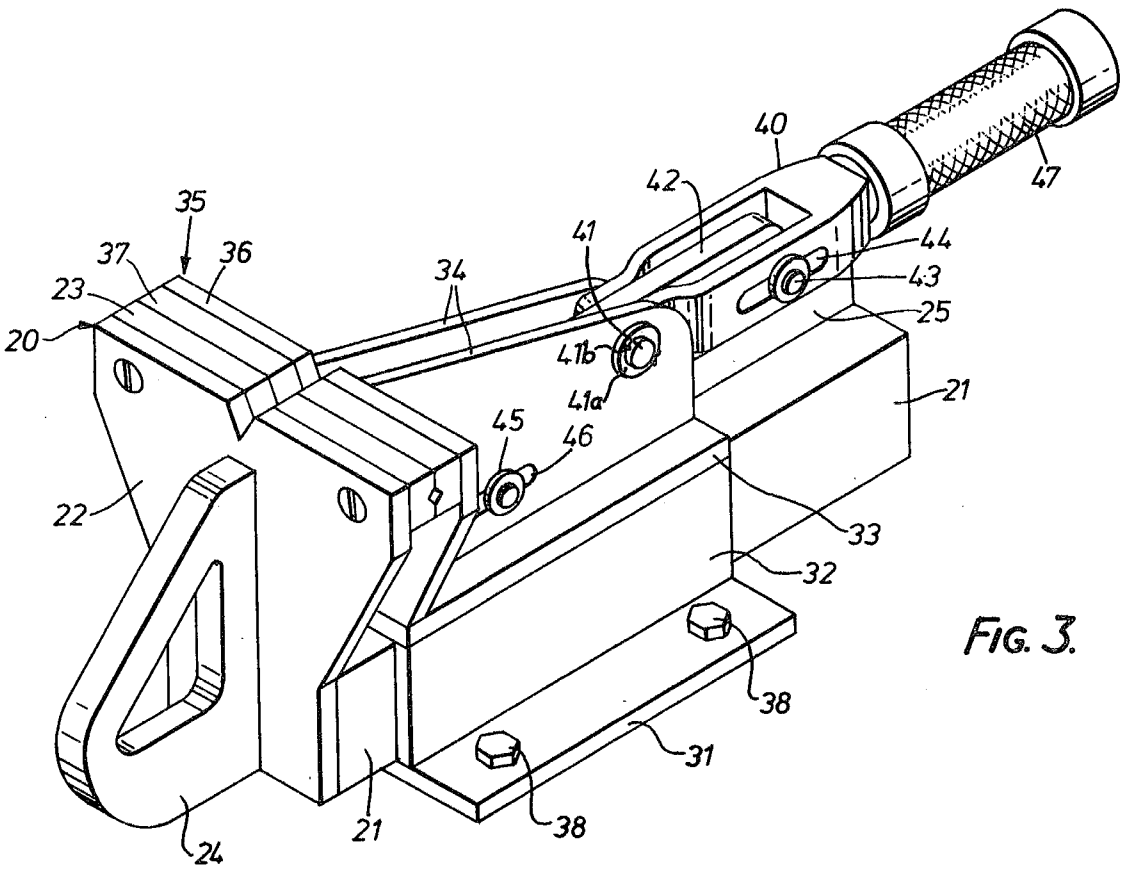
FIG. 3 shows a perspective view of the embodiment of FIG. 1.

Upon referring to the drawings, it will be seen that the clamp device comprises a movable jaw 20 which is co-extensive with an adjusting arm 21 lying approximately at right angles thereto. Arm 21 is of hollow, rectangular cross-section, and jaw 20 comprises a plate 22 having a removable jaw member 23 affixed thereto. Handle 24 is also provided on plate 22. Rack 25, extending longitudinally of arm 21 has a series of notches 26, preferably of semi-circular or saw-tooth shape, provided therealong. Arm 21 is slidably movable within the hollow housing 30 which, as shown particularly in FIG. 2, comprises a base plate 31 provided with apertures 38, side plates 32 and sections 33 forming a top of the housing. Attached to each section 33 is one of the side cheeks 34. Main jaw 35 at one end of the housing 30 comprises a plate 36 affixed to the side cheeks 34 and sections 33 of the top of the housing, having a removable jaw member 37 affixed thereto.

Figure 1:
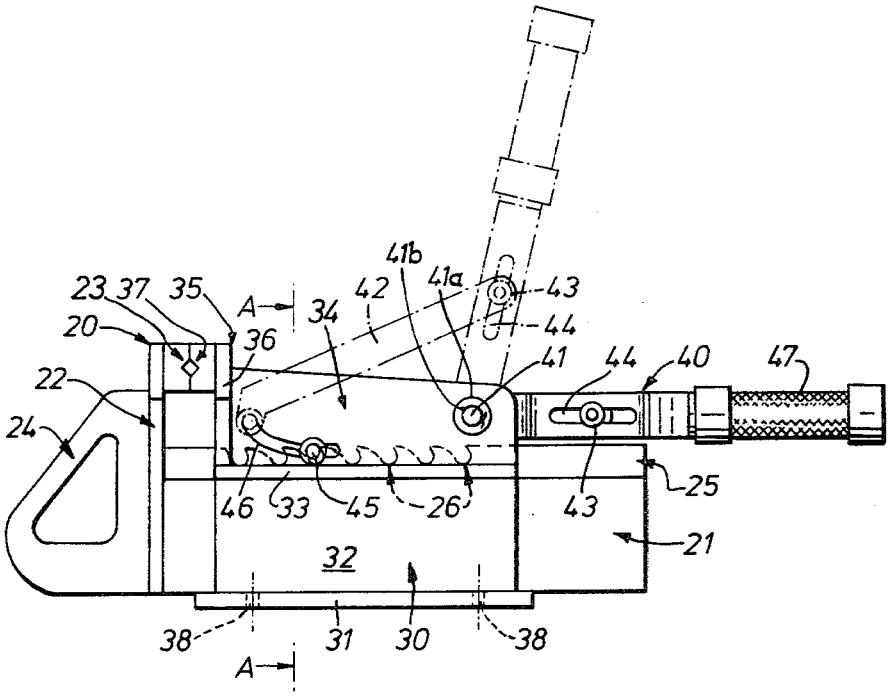
FIG. 1 shows, in side elevation, a detailed view of the preferred embodiment of the present invention.

A tension lever 40 is pivotally mounted on removable pin 41, which passes through boss 41*a* on each side of the cheeks 34, and is held in position by removable pin 41*b*. A secondary lever 42 is attached at one end to the tension lever 40 via the swivel pin 43, which is adapted to slide within the travelling slot 44. Secondary lever 42 is attached at its other end to a sliding pin 45 which is capable of sliding relationship with the travelling slots 46 in the cheeks 34. The pin 45 may also engage selectively one or other of the notches 26 in the rack 25. The configuration of travelling slots 46 constitutes an important aspect of the present invention. As shown, these slots include an arcuate portion which curves away from the adjusting arm 21 and guides sliding pin 45 towards and away from the notches 26 in the rack 25 as the pin is moved back and forwards along the slot 46 by pivotal movement of the tension lever 40 and by virtue of the linkage which secondary lever 42 makes between the tension lever 40 and the pin 45. When tension lever 40 is pivoted upwards as shown in FIG. 1, pin 45 is moved into the arcuate portion of the slot 46 and out of engagement with the notches in the rack 25. This operating position of the device is shown in dotted outline in FIG. 1. In this position, the adjusting arm is freely slidable within the housing to enable the jaws 20 and 35 to be set with respect to a work-piece.

Upon downward pivotal movement of the tension lever 40 pin 45 is slid along the slot 46 until it engages one of the notches 26 in the rack 25. In this intermediate position, the arm is no longer freely slidable relative to the housing because of this engagement of the pin 45 in one of the notches 26. Upon pivoting the tension lever 40 further downwards into the lock position shown in solid outline in FIG. 1, wherein the lever 40 is substantially parallel with the adjusting arm 21, the over-centre action provided by the pivot 41 together with the secondary lever 42, the swivel pin 43 and the sliding pin 45, causes the jaws 20 and 35 to grip the work-piece tightly.

Should the tension on the lever 40 be too great to allow it to be pulled down to the lock position from the intermediate position, the tension lever may be rotated upwards again to the intermediate position, whereupon the handle 47 of said lever may be rotated about its longitudinal axis to vary the position of the swivel pin 43 along the length of the travelling slot 44 by advancing or retracting an adjusting member which is in threaded engagement with handle 47 and extends between the handle and swivel pin 43. Thus, upon again depressing the tension lever 40 into the lock position shown in FIG. 1, the locking position may be assumed again whereby the work-piece is firmly held. Alternatively, if initially the depression of the tension lever 40 provides too little gripping force between the jaws 20 and 35 despite the selection of the best available notch 26 by the pin 45, an appropriate rotation of the handle of the tension lever about its longitudinal axis will adjust the arc described by swivel pin 43, so as to correspondingly increase the force necessary to cause said lever to pass beyond the over-centre position into the locking position above described.

The entire clamp may be constructed from any suitable durable material such as mild steel, tool steel or the like, and may have a large range of sizes.

Whilst one particular embodiment of the present invention has been described herein, it will be appreciated that this is described by way of example only and that many modifications and variations may be made thereto without departing from the spirit and scope of the present invention.

What we claim:

1. A tension clamp device which comprises, in combination, a movable jaw co-extensive with an elongated adjusting arm, a hollow housing through which said adjusting arm is adapted to pass freely, said hollow housing being adapted to be mounted on a fixed base and having a main jaw integral therewith, a tension lever pivotally attached to and between two spaced, parallel side cheeks of said housing, a secondary lever pivotally fastened at one end thereof to said tension lever, the other end of said secondary lever being constrained with respect to said housing by means of a pin in sliding relationship with respect to a pair of registering travelling slots, each formed within a respective one of said side cheeks of said housing, said pin being adapted to engage selectively one of a plurality of notches formed in a rack extending longitudinally of said adjusting arm, and said pair of travelling slots being adapted to guide sliding movement of said pin therealong from a first position wherein said pin is free of engagement with said notches to a second position wherein said pin engages said one of said notches, whereby pivotal movement of said tension lever with respect to said housing initially causes said pin to slide along said pair of travelling slots from said first position to said second position whereby free sliding motion of said adjusting arm within said housing is prevented by the engagement of said pin in said notch, and then causes said housing to lock securely with respect to said adjusting arm by an over-centre action to grip firmly within said jaws any work-piece located therebetween, each of said pair of travelling slots being arcuate at the end thereof corresponding to said first position of said pin.

2. A device as claimed in claim 1, wherein said secondary lever is pivotally connected to said tension lever by a swivel pin adapted for adjustable location within a travelling slot formed in the tension lever.

3. A device as claimed in claim 2 wherein said adjustable location of said swivel pin within the travelling slot formed in the tension lever is provided by means of a rotatable handle on said tension lever in threaded engagement with an adjusting member extending longitudinally of said tension lever from said handle to the swivel pin, whereby rotation of said handle will cause said adjusting member to slide said swivel pin in said travelling slot.

4. A device as claimed in claim 1, wherein said elongate adjusting arm is of hollow square or rectangular cross-section, and said longitudinal rack is affixed along and extends outwardly from one side thereof.

5. A device as claimed in claim 1, wherein a first plate which forms, or forms a base for, the movable jaw is affixed at one end of said adjusting arm transversely to the longitudinal direction thereof, and a handle is provided on the side of said first plate remote from said adjusting arm.

6. A device as claimed in claim 1, wherein said hollow housing comprises a base plate adapted to be mounted on a fixed base, a top plate spaced from and extending parallel to said base plate and a pair of spaced, parallel side plates extending between said base plate and said top plate so as to closely surround the adjusting arm while still allowing said arm to pass freely therethrough, said top plate comprising two sections, each of which extends from one of said side plates to a position adjacent a respective side of the longitudinal rack on said adjusting arm, and each of said spaced, parallel side cheeks being provided on a respective one of said top plate sections so that said rack is aligned therebetween.

7. A device as claimed in claim 6, wherein a second plate which forms, or forms a base for, the main jaw is affixed at one end of said hollow housing transversely to the longitudinal direction thereof.

8. A tension clamp device which comprises, in combination, a movable jaw co-extensive with an elongated adjusting arm, a hollow housing through which said adjusting arm is adapted to pass freely, said hollow housing being adapted to be mounted on a fixed base and having a main jaw integral therewith, a tension lever pivotally attached to and between two spaced, parallel side cheeks of said housing, a secondary lever pivotally fastened at one end thereof to said tension lever, the other end of said secondary lever being constrained with respect to said housing by means of a pin in sliding relationship with respect to a pair of registering travelling slots, each formed within a respective one of said side cheeks of said housing, said pin being adapted to engage selectively one of a plurality of notches formed in a rack extending longitudinally of said adjusting arm, and said pair of travelling slots being adapted to guide sliding movement of said pin therealong from a first position wherein said pin is free of engagement with said notches to a second position wherein said pin engages said one of said notches, each of said pair of travelling slots being arcuate at the end thereof corresponding to said first position of said pin, said pin being slidably moved along said pair of travelling slots from said first position to said second position in response to initial pivotal movement of said tension lever with respect to said housing, the engagement of said pin in said notch in the second position of said pin being operative to prevent free sliding motion of said adjusting arm within said housing, and said housing being locked securely with respect to said adjusting arm by an over-centre action in response to further pivotal movement of said tension lever with respect to said housing thereby to grip firmly within said jaws any work-piece located therebetween.

* * * * *